US007854055B2

(12) United States Patent
Fusegawa et al.

(10) Patent No.: US 7,854,055 B2
(45) Date of Patent: Dec. 21, 2010

(54) METHOD FOR PRODUCING A COMMUTATOR

(75) Inventors: Shuichi Fusegawa, Maebashi (JP); Minoru Isoda, Midori (JP); Keiji Tojyo, Kiryu (JP)

(73) Assignee: Mitsuba Corporation, Kiryu-shi (JP)

( * ) Notice: Subject to any disclaimer, the term of this patent is extended or adjusted under 35 U.S.C. 154(b) by 212 days.

(21) Appl. No.: 12/000,630

(22) Filed: Dec. 14, 2007

(65) Prior Publication Data

US 2008/0143212 A1 Jun. 19, 2008

(30) Foreign Application Priority Data

Dec. 15, 2006 (JP) ..... 2006-338956

(51) Int. Cl.
*H01R 43/08* (2006.01)

(52) U.S. Cl. ..... 29/597; 310/236

(58) Field of Classification Search ..... 29/597; 310/236

See application file for complete search history.

(56) References Cited

U.S. PATENT DOCUMENTS 6,713,931 B2 * 3/2004 Kamiya et al. ..... 310/235

FOREIGN PATENT DOCUMENTS

| | | |
|---|---|---|
| JP | A-2003-231132 | 8/2003 |
| JP | A-2004-216434 | 8/2004 |
| WO | WO 8303324 A1 * | 9/1983 |

* cited by examiner

*Primary Examiner*—A. Dexter Tugbang
*Assistant Examiner*—Livius R Cazan
(74) *Attorney, Agent, or Firm*—Oliff & Berridge, PLC

(57) ABSTRACT

A commutator includes a conductive part that has a cylindrical body and a plurality of coil latching portions at intervals circumferentially on one axial end; and an insulating part formed inside the conductive part. The conductive part includes segments that are insulated for each latching portion by cutting axially the conductive part, and latching claws that are provided in a projecting state on an inner peripheral surface of the segments and embedded in the insulating part, wherein the latching claws include axial latching claws that are long in an axial direction and project inward, and circumferential latching claws that project circumferentially.

5 Claims, 17 Drawing Sheets

(A)

(B)

(A)

(B)

(C)

(A)

(B)

(A)

(B)

(C)

(A)

(B)

(C)

(D)

(A)

(B)

(A)

(B)

(C)

(A)

(B)

(C)

METHOD FOR PRODUCING A COMMUTATOR

CROSS-REFERENCE TO RELATED APPLICATION

This application claims priority from Japanese Patent Application No. 2006-338956, filed Dec. 15, 2006, the entire disclosure of which is incorporated herein by reference in its entirety.

BACKGROUND

The present disclosure relates to a commutator.

There exists a commutator to be provided in an electric motor that has a plurality of segments that are formed on an outer peripheral surface. A riser is formed on one end in an axial direction of each segment. In an armature of an electric motor, the commutator is integrally externally fitted to a shaft. A winding that forms a coil that is wound around the armature is laid around the risers, whereby the segments and the coil are electrically connected to each other.

The commutator is formed such that, on an inner periphery of a cylindrical body that is formed of a conductive plate member and on which latching claws are formed, an insulating resin part is integrally molded. Thereafter, the outer peripheral surface of the cylindrical body is cut in order to form a plurality of segments on the outer peripheral surface. The commutator is required to have high circularity (shaft alignment) in view of motor performance and durability of the electric motor.

In order to have high circularity for motor performance and durability of the electric motor, a proposed cylindrical body that has latching claws that are formed on its peripheral surface is formed such that a long plate member is bent and formed into a cylindrical body. The cylindrical body is also formed by forcibly inserting a columnar mold that has claw forming grooves that are formed on its outer periphery into the cylindrical body (see Japanese Published Unexamined Patent Application No. 2003-231132 for example).

SUMMARY

Around the riser of each segment of the commutator, the winding is laid with a fixed tension. When the electric motor is driven, a centrifugal force is applied to each segment. In order to adapt to heat contraction of a molded resin part, the segments and the resin part are required to have a high peel strength. The peel strength of the conventional commutator is, however, insufficient. A structure of the latching claws that increases the peel strength (resistance against peeling) of both the segments and the resin part has been demanded. The present disclosure solves this problem as well as other problems and is also able to achieve various advantages.

The disclosure addresses an exemplary aspect of a commutator includes a conductive part that has a cylindrical body and a plurality of coil latching portions at intervals circumferentially on one axial end; and an insulating part formed inside the conductive part. The conductive part includes segments that are insulated for each latching portion by cutting axially the conductive part, and latching claws that are provided in a projecting state on an inner peripheral surface of the segments and embedded in the insulating part, wherein the latching claws include axial latching claws that are long in an axial direction and project inward, and circumferential latching claws that project circumferentially from tip ends of the axial latching claws.

In another exemplary aspect, a pair of the axial latching claws oppose each other circumferentially, and the circumferential latching claws of the pair of the axial latching claws oppose each other circumferentially.

In another exemplary aspect, the axial latching claws extend from an end of the conductive part at which the coil latching portion is formed to an end that has no coil latching portion.

In another exemplary aspect, a mold for producing a commutator that includes a conductive part that has a cylindrical body and a plurality of coil latching portions at intervals circumferentially on one axial end, and an insulating part formed inside the conductive part, wherein the conductive part includes segments that are insulated for each latching portion by cutting axially the conductive part, and latching claws that are provided in a projecting state on an inner peripheral surface of the segments and embedded in the insulating part, wherein after the conductive part is formed into the cylindrical body by bending and forming a long plate member, latching claws are formed on a cylindrical body inner peripheral surface by forcibly inserting the mold into the cylindrical body, the mold including a mold surface that forms axial latching claws that are long in an axial direction and project inward by cutting and raising a thickness of the cylindrical body inner peripheral surface; and a mold surface that forms circumferential latching claws that project circumferentially from tip ends of the axial latching claws.

In another exemplary aspect, the mold surface that forms the axial latching claws and the mold surface that forms the circumferential latching claws are formed on the same mold.

In another exemplary aspect, the mold surface that forms the axial latching claws and the mold surface that forms the circumferential latching claws are formed so as to form a pair of the axial latching claws in a circumferential direction across the coil latching portion and form and oppose the circumferential latching claws to each other circumferentially.

In another exemplary aspect, the mold surface that forms the axial latching claws and the mold surface that forms the circumferential latching claws are formed on separate molds.

In another exemplary aspect, the mold surface that forms the axial latching claws form a pair of the axial latching claws in a circumferential direction across the coil latching portion, and the mold surface that forms the circumferential latching claws forms the circumferential latching claws toward both sides in the circumferential direction.

In another exemplary aspect, a method for producing a commutator that includes a conductive part that has a cylindrical body and a plurality of coil latching portions at intervals circumferentially on one axial end; and an insulating part formed inside the conductive part, wherein the conductive part includes segments that are insulated for each latching portion by cutting axially the conductive part, and latching claws that are provided in a projecting state on an inner peripheral surface of the segments and embedded in the insulating part, includes forming the conductive part into the cylindrical body by bending and forming a long plate member; and forming latching claws on a cylindrical body inner peripheral surface by forcibly inserting a mold into the cylindrical body, wherein the mold has a mold surface that forms axial latching claws that are long in an axial direction and project inward by cutting and raising a thickness of the cylindrical body inner peripheral surface, and a mold surface that forms circumferential latching claws that project circumferentially from tip ends of the axial latching claws.

In another exemplary aspect, the axial latching claws and the circumferential latching claws are formed by forcibly inserting the same mold.

In another exemplary aspect, after the axial latching claws are formed, the circumferential latching claws are formed.

According to various exemplary aspects of the disclosure, while the commutator is high in circularity, on the segment, as latching claws are embedded in the resin part, axial latching claws and circumferential latching claws at a tip ends of the axial latching claws are integrally formed. The peel strength of the resin part is thus increased.

According to various exemplary aspects of the disclosure, on the segment, at tip ends of the pair of axial latching claws that oppose each other in the circumferential direction, formed are circumferential latching claws that project circumferentially while opposing each other. A dovetail-shaped resin part housing is formed with its axis side being narrowed as a resin part entrance side. Higher peel strength is thus realized.

According to various exemplary aspects of the disclosure, because the circumferential latching claws project to both sides in the circumferential direction, the peel strength is higher.

According to various exemplary aspects of the disclosure, the integration strength between the segment and the resin part can be increased not only in the circumferential direction but also in the axial direction.

According to various exemplary aspects of the disclosure, because a commutator with high peel strength can be formed by one forcible inserting operation, the workability is improved.

According to various exemplary aspects of the disclosure, a commutator that includes circumferential latching claws that project to both sides in the circumferential direction can be easily produced.

BRIEF DESCRIPTION OF THE DRAWINGS

Various embodiments of the disclosure will be described with reference to the drawings, wherein.

Of a cylinder state subjected to latching claw processing.

Of a cylindrical body subjected to latching claw processing of the second embodiment.

Of a commutator showing a third embodiment.

Of a cylinder state subjected to latching claw processing.

DETAILED DESCRIPTION OF EMBODIMENTS

Figure 1:
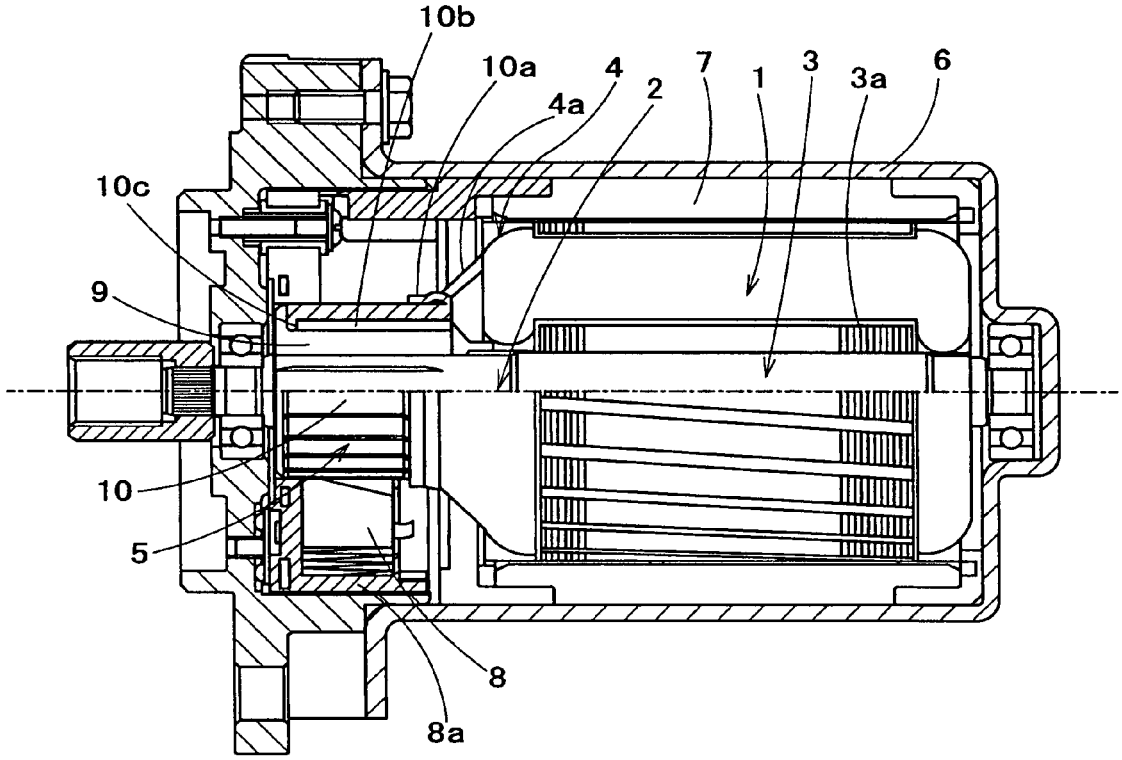
FIG. 1 is a sectional side view of an electric motor.

Next, a first embodiment of the present disclosure will be described with reference to the drawings. In FIG. 1, the reference numeral 1 denotes an armature of an electric motor. This armature 1 includes an armature shaft (motor shaft) 2, an armature core 3 that is formed of a plurality of thin plate-shaped core members 3*a* that are integrally externally fitted to the motor shaft 2 in a state laminated on the outer periphery, a coil 4 wound around the outer periphery of the armature core 3, and a commutator 5 that is integrally externally fitted to one end of the armature shaft 2 and to which an end of the coil 4 is electrically connected.

The reference numeral 6 denotes a motor yoke that axially supports the armature 1 rotatably. On the inner peripheral surface of the motor yoke 6, a pair of permanent magnets 7 are provided. A brush holder stay 8*a*, in which the brush 8 that comes into sliding contact with the commutator 5 is housed, is installed so as to project and withdraw. By supplying an external power supply to the coil 4 via the brush 8 and the commutator 5, the armature 1 rotates integrally with the armature shaft 2.

Figure 2:
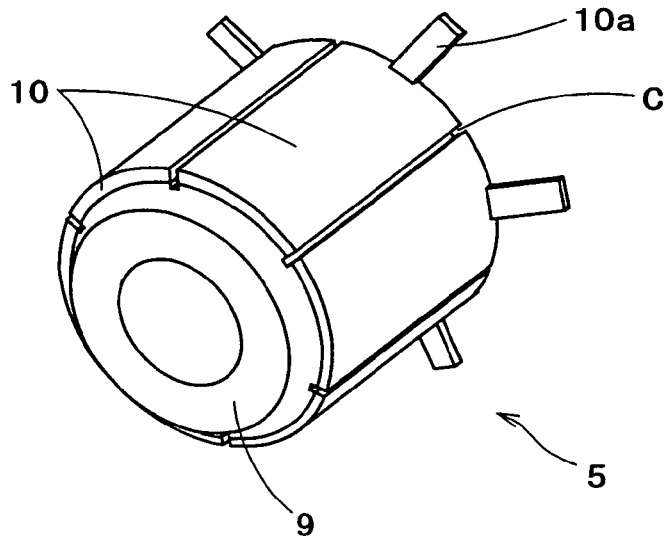
FIG. 2A is a perspective view of a commutator and FIG. 2B is a sectional view of a commutator.
Figure 2:
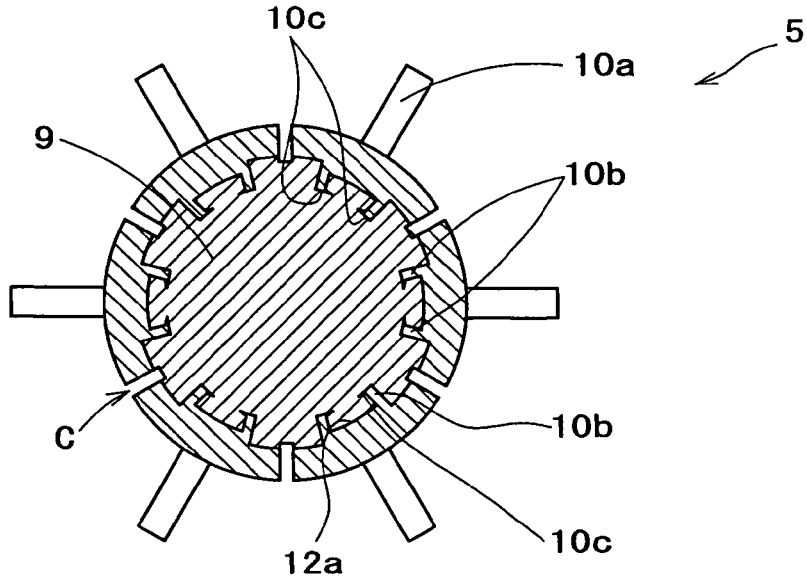

The commutator 5 includes an insulating resin part 9 (which is an example of an insulating part) into which the armature shaft 2 is fitted integrally, and a plurality (six in this embodiment) of segments 10 which are integrally arranged circumferentially on the outer periphery of the resin part 9. The segments 10 (which are an example of a conductive part) are formed of a conductive plate member and insulated from adjacent segments by cut grooves C. At an end positioned on the armature core 3 side of each segment 10, a riser 10*a*, around which an end of a winding 4*a* forming the coil 4 is laid to make an electrical connection to each segment 10, is formed by bending in the direction toward the outer diameter (see FIGS. 2A and 2B). On the inner peripheral surface of each segment 10, as shown in FIG. 2B, axial latching claws 10*b* are formed so as to be long in the axial direction and project in the direction toward the inner diameter (project inward), and circumferential latching claws 10*c* projecting circumferentially from tip ends of the axial latching claws 10*b* are integrally formed in a state that they are embedded in the resin part 9. By forming these latching claws 10*b* and 10*c*, the integration strength in the circumferential direction against a load in the circumferential direction and integration strength against a load in the axial direction of the segments 10 with the resin part 9 can be increased.

Figure 3:
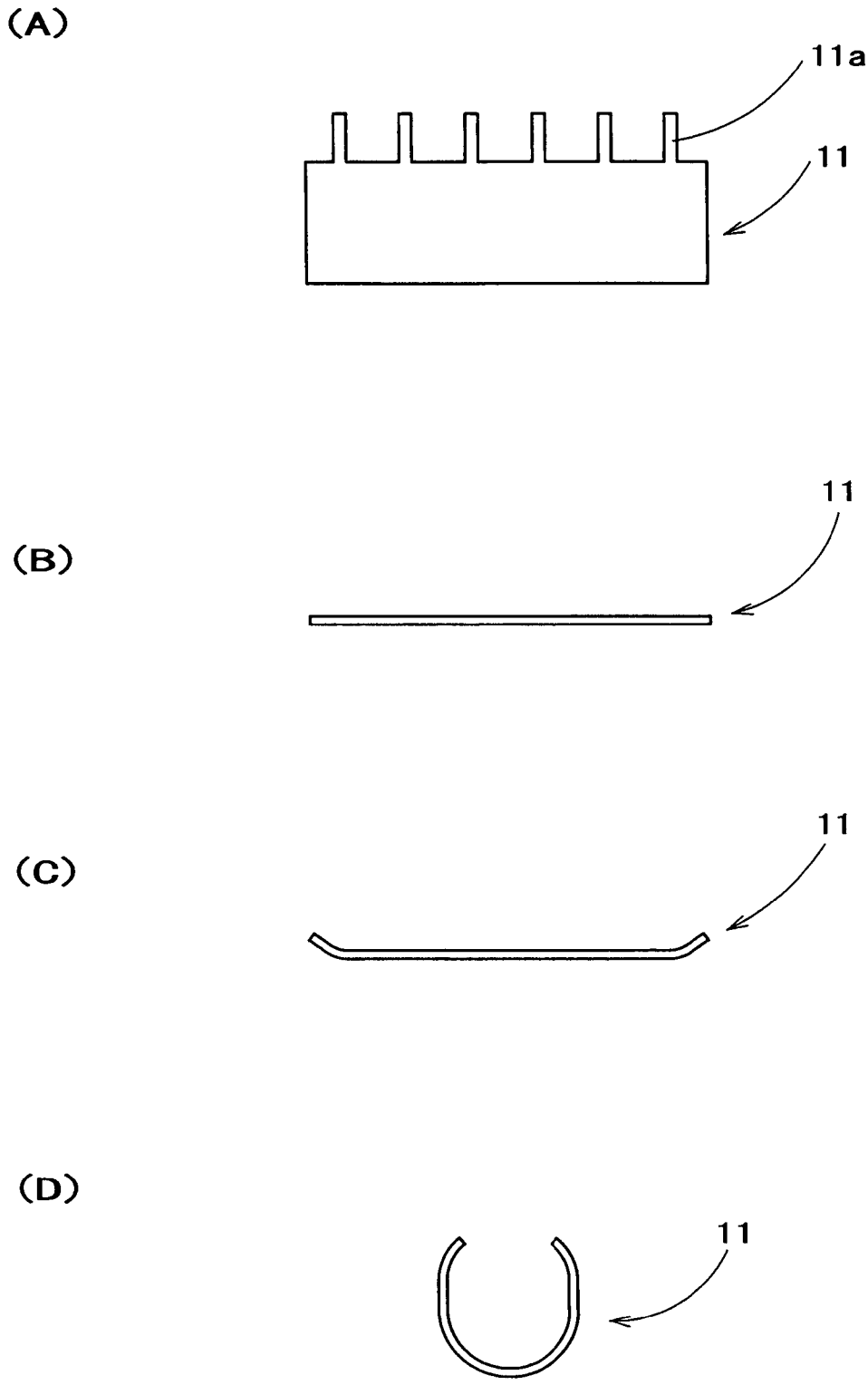
FIGS. 3A-3D illustrate processing steps of a plate.
Figure 4:
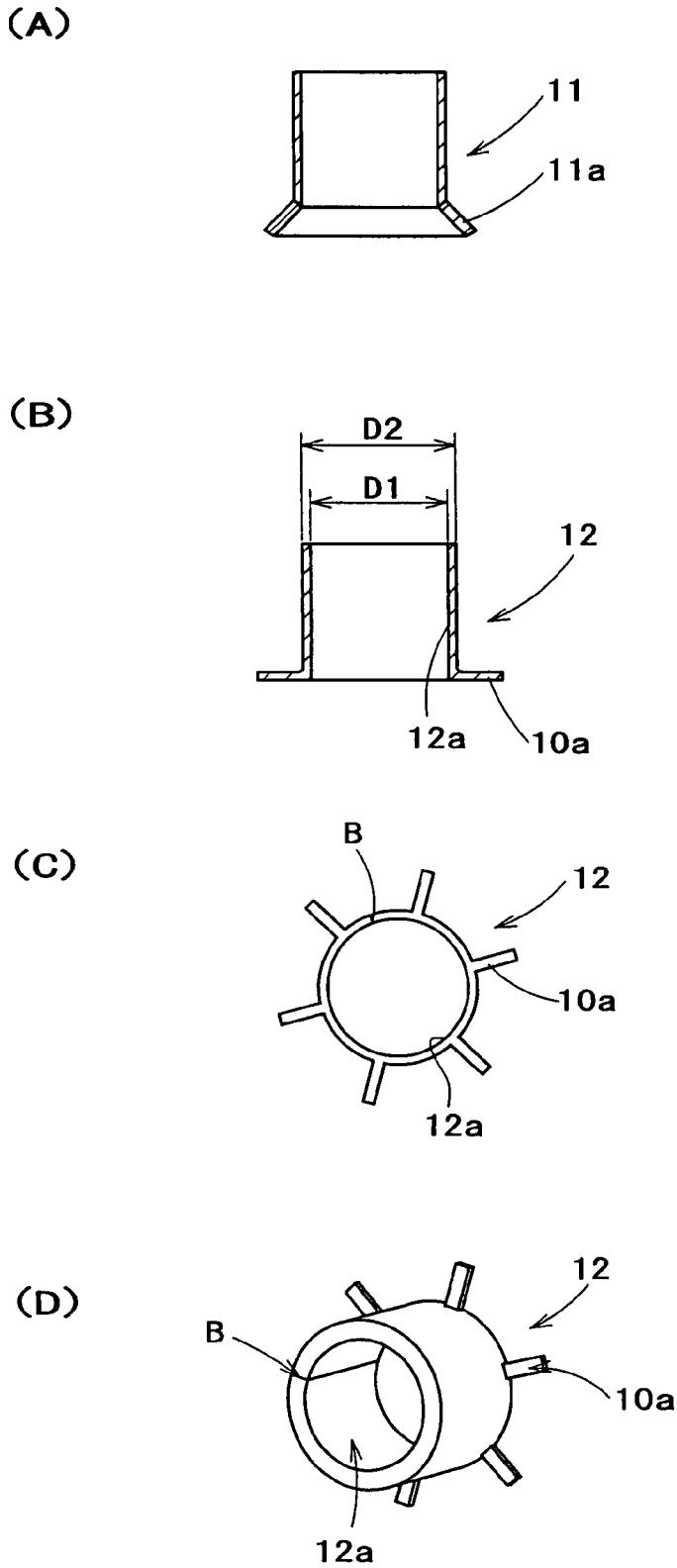
FIGS. 4A-4D illustrate processing steps of a cylindrical body.
Figure 5:
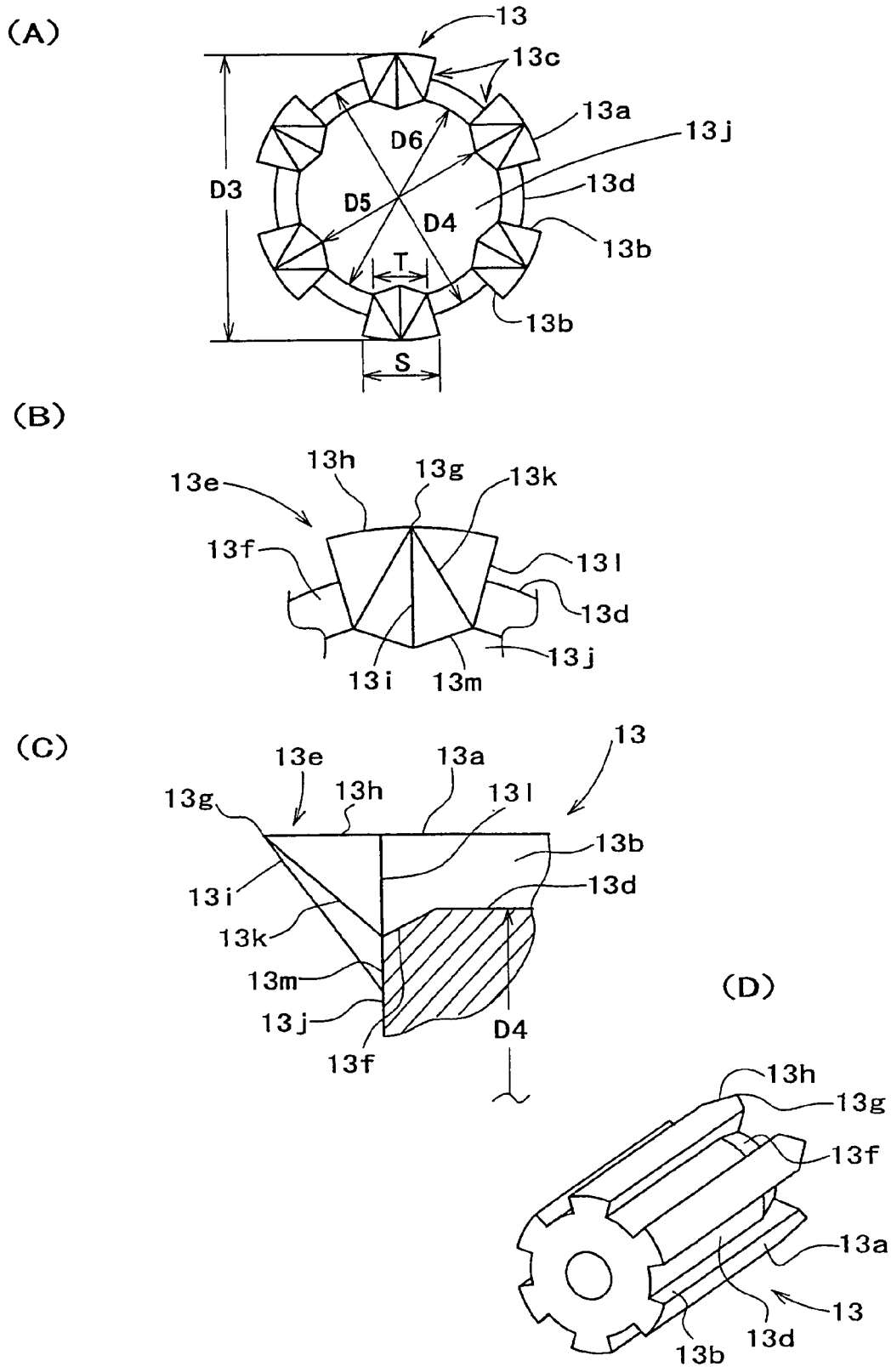
FIG. 5A is a front view of a first mold.
FIG. 5B is a main portion enlarged front view of a first mold.
FIG. 5C is a main portion enlarged sectional view of a first mold.
FIG. 5D is a perspective view of a first mold.
Figure 6:
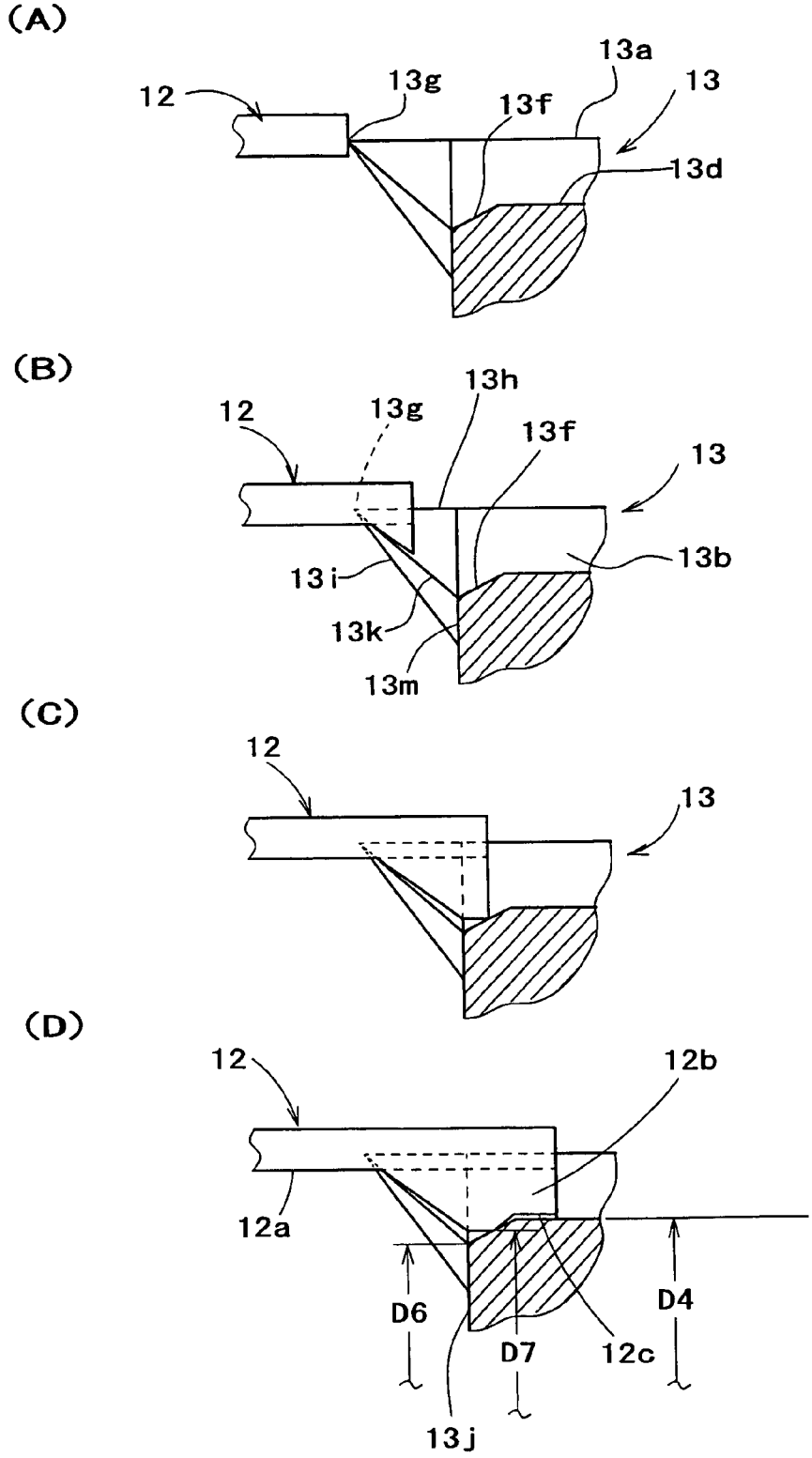
FIGS. 6A-6D show latching claw processing states.
Figure 7:
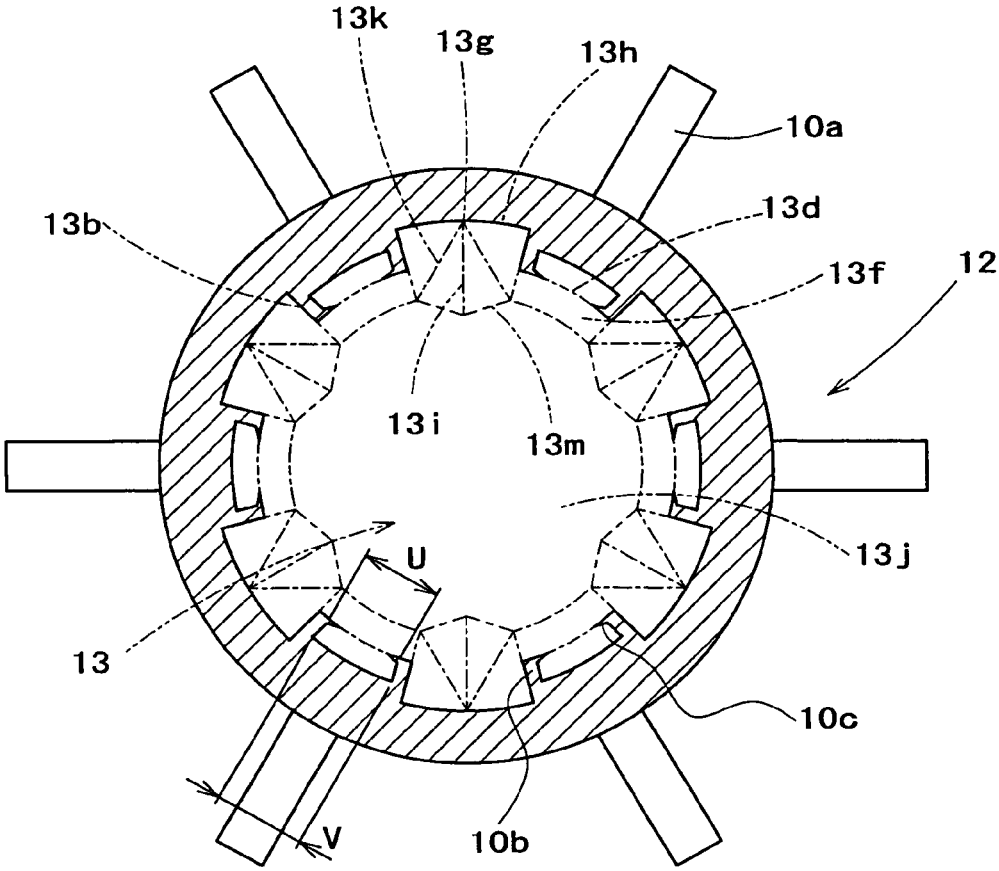
FIG. 7 is a sectional view of a cylindrical body showing a state that a first mold is forcibly inserted therein.
Figure 8:
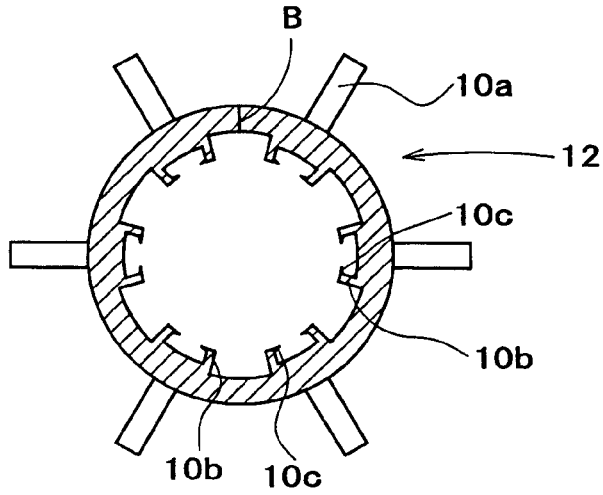
FIG. 8A is a front sectional view.
FIG. 8B is a front perspective view.
FIG. 8C is a back perspective view.
Figure 8:
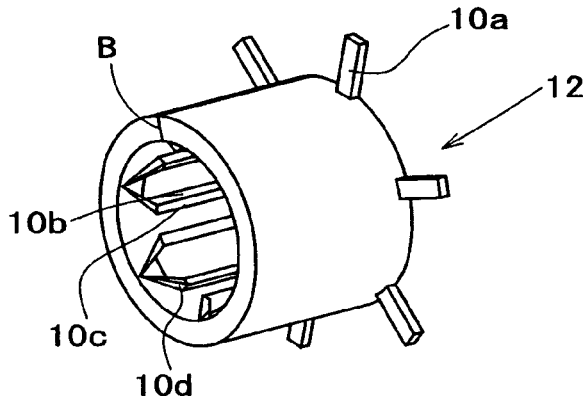
Figure 8:
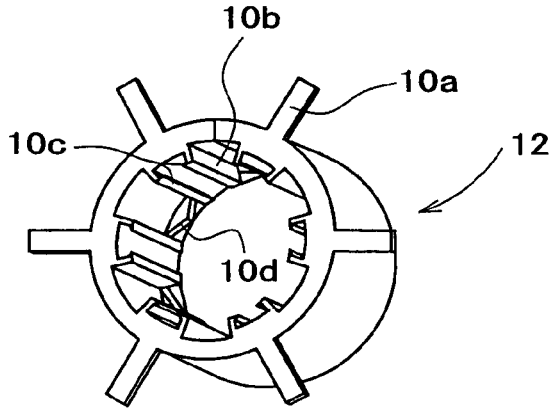

Next, procedures for forming the commutator 5 will be described with reference to FIGS. 3-8. As portions of the commutator 5 to be the segments 10, a long plate member (blank) 11 that is formed of a flat conductive plate member is cut into a predetermined shape as shown in FIGS. 3A and 3B. On one longer side (one side edge) of the long plate member 11, six riser corresponding portions 11*a* which become risers 10*a* are formed. The long plate member 11 is sequentially bent into a cylindrical shape as shown in FIGS. 3C and 3D, and at this time, the riser corresponding portions 11*a* are left extended in the cylinder axial direction.

Subsequently, as shown in FIGS. 4A and 4B, the riser corresponding portions 11*a* that extend in the cylinder axial direction are bent in the direction toward the outer diameter. As shown in FIGS. 4C and 4D, a cylindrical body 12 that has a cylindrical inner peripheral surface 12*a* and risers 10*a* that project to one end in the direction toward the outer diameter is formed. In the process of bending and forming the riser corresponding portions 11 in the direction toward the outer diameter, circular formation of the cylindrical body 12 is also performed. The cylindrical body 12 is formed so as to have a predetermined inner diameter D1 and a predetermined outer diameter D2. "B" denotes a butting portion of a plate end face.

Next, on the inner peripheral surface 12*a* of this cylindrical body 12, axial latching claws 10*b* and circumferential latching claws 10*c* are formed. These latching claws 10*b* and 10*c* are formed by forcibly inserting a first mold 13 that is formed to be columnar into the inner peripheral surface of the cylindrical body 12 (see FIGS. 5A-5D, 7 and 8A-8C). On the outer peripheral surface of the first mold 13, latching claw forming grooves are formed in the axial direction. A large-diameter portion 13*a* set to have a large outer diameter D3 and a small-diameter portion 13*d* set to have a small outer diameter D4 (D3>D4) are alternately formed circumferentially. As shown in FIGS. 5A and 5B, six large-diameter portions 13*a* and six small-diameter portions 13*d* are formed in this embodiment (this number is based on the number of slots of the armature core 3, however, and is not limited in particular).

In this mold, the small-diameter portion 13*d* leads to the large diameter portion 13*a* via a stepped portion 13*b*. A corner 13*c* between the small-diameter portion 13*d* and the stepped portion 13*b* is formed into a predetermined corner shape (round shape). The outer diameter D3 of the large-diameter portion 13*a* is set to be larger than the inner diameter D1 of the cylindrical body 12 and smaller than the outer diameter D2 of the cylindrical body 12 (D2>D3>D1). On the other hand, the outer diameter D4 of the small-diameter portion 13*d* is set to be smaller than the inner diameter D1 of the cylindrical body 12 (D4<D1) as shown in FIGS. 4B and 5A. Further, the large-diameter portion 13*a* is set such that a circumferential opposing width S at the tip end side is larger than a circumferential opposing width T on the base end side, that is S>T (see FIG. 5A).

On the tip end in the inserting direction corresponding to one axial end of the first mold 13, a pointed portion 13*e* is formed at a portion corresponding to the large-diameter portion 13*a*. At a portion corresponding to the small-diameter portion 13*d*, a chamfered portion 13*f* is formed (see FIGS. 5B and 5C). This pointed portion 13*e* has an apex 13*g* that is formed by projecting the portion corresponding to the large-diameter portion 13*a* in the axial direction (inserting direction) while maintaining the outer diameter D3 of the large-diameter portion 13*a* and pointing the middle portion (central portion) in the circumferential direction of the large-diameter portion 13*a* toward the projecting end. Ridges 13*h* are formed so as to lead to both circumferential outer-diameter ends of the large-diameter portion 13*a* from the apex 13*g*. A ridge 13*i* is formed so as to lead to an insertion side end face 13*j* of the first mold 13 so that the inner diameter D5 becomes smaller than the outer diameter D4 of the small-diameter portion 13*d* from the apex 13*g* along a radial line that the apex 13*g* passes through.

The chamfered portion 13*f* is set so that the insertion side end face 13*j* is smallest in diameter and the diameter increases toward the insertion base end side and becomes equal in diameter to the small-diameter portion 13*d*. The outer diameter D6 of the chamfered portion 13*f* on the insertion end face 13*j* is larger than the inner diameter D5 on the insertion end face 13*j* of the ridge 13*i* but is smaller than the outer diameter D4 of the small-diameter portion 13 (D5<D6<D4) as shown in FIG. 5A. Further, on the pointed portion 13*e*, formed are ridges 13*k* leading to the insertion side end face 13*j* of the chamfered portion 13*f* from the apex 13*g*, portions 13*i* leading to the chamfered portion 13*f* from the ridges 13*h* at a portion corresponding to the insertion side end face 13*j*, and valleys 13*m* leading from the ridge 13*i* to the chamfered portion 13*f*. By the pointed portion 13*e* and the chamfered portion 13*f*, the latching claws 10*b* and 10*c* described above are formed. This formation will be described in detail next.

The side on which the pointed portion 13*e* of the first mold 13 is formed is butted against one cylindrical end (base end) on the side on which the risers 10*a* are formed of the cylindrical body 12. From this state, the first mold 13 is forcibly inserted toward the other end side (tip end side) of the cylindrical body 12 and forcibly pushed to the tip end side of the cylindrical body 12 to perform extruding. Thereby, portions corresponding to the large-diameter portions 13*a* on the inner peripheral surface 12*a* of the cylindrical body 12 are extruded by the pointed portions 13*e* and the large-diameter portions 13*a*. A pair of axial latching claws 10*b* are formed to be long axially along the stepped portions 13*b* opposing each other in the circumferential direction of the large-diameter portions 13. At the tip ends of the axial latching claws 10*b*, circumferential latching claws 10*c* are formed by the chamfered portion 13*f* (see FIGS. 5C, 7, and 8A-C).

That is, when the first mold 13 is forcibly inserted into the cylindrical body 12, the apex 13*g* of the pointed portion 12*e* maintaining the outer diameter D4 bites into the inner peripheral surface so to have the inner diameter D4 that is smaller than the outer diameter D2 of the cylindrical body 12 (see FIGS. 6A and 6B). Then, the thickness of the bitten cylindrical body 12 is divided to both sides in the circumferential direction by the ridge 13*i* and raised so as to become longer toward the axis core while opening and moving toward the smaller-diameter portion 13*d* sides in the circumferential direction by the surface formed by the ridges 13*h* and 13*k* (see FIG. 6C). After that, the cutting and raising amount is set so that, when the cut and raised portions 12*b* reach the insertion end face 13*j*, the inner diameter D7 of the tip ends 12*c* thereof is equal to or larger than the outer diameter D6 of the chamfered portion 13*f*, but is smaller than the outer diameter D4 of the small-diameter portion 13*d* (D4>D7≧D6) as shown in FIG. 6D.

As a result, the cut and raised tip ends 12*c* come into contact with the chamfered portion 13*f* and are bent circumferentially when the forcible insertion advances, and thereby, the circumferential latching claws 10*c* are integrally formed on the tip ends of the axial cut and raised claws 10*b* (see FIGS. 7 and 8A-C). In this embodiment, the large-diameter portion 13*a* is forcibly inserted between adjacent segments 10 and cuts and raises the inner thickness of the cylindrical body 12, so that into the portions corresponding to the risers 10*a* slightly wider in width than the risers 10*a*, the small-diameter portion 13*d* is inserted and cut-raising is not caused, so that the inner diameter D1 of the cylindrical body 12 is maintained. On both sides in the circumferential direction thereof, a pair of axial latching claws 10*b* are formed by being cut and raised, and on the tip ends thereof, circumferential latching claws 10*c* opposing each other circumferentially are integrally formed. At the outsides in the circumferential direction of the circumferential latching claws, the inner circumferential surface with the inner diameter D3 of the cylindrical body 12 is made thin due to cutting and raising of the thickness by the large-diameter portions 13*a*.

In this embodiment, the forcible insertion in this case is set so as to stop before the pointed portions 13*e* get through the cylindrical body 12. Accordingly, the cylindrical body 12 is provided with, at the tip end thereof, a non-inserted portion into which the first mold 13 is not inserted. On the other cylinder end of the cylindrical body inner peripheral surface 12*a* (corresponding to the mold inserting direction tip end of the present disclosure), a tip end axial engagement claw 10*d* whose tip end is closed along the shape of the pointed portion 13*e* is formed. At this time, the pairs of axial latching claws 10*b* and the circumferential latching claws 10*c* lead continuously to the tip end axial latching claw 10*d*.

By molding a resin part 9 in the cylindrical body 12 thus formed, the resin part 9 is integrated with the inner periphery of the cylindrical body 12. By applying cutting to the outer peripheral surface thereof, cut grooves C that reach the resin part 9 and are long axially are formed. Accordingly, the cylindrical body 12 is divided into a plurality of segments 10 in the circumferential direction, and the commutator 5 described above is constructed (see FIGS. 2A and 2B).

In the embodiment constituted as described above, in the commutator 5, by forcibly inserting the first mold 13 into the cylindrical body 12 that is formed of a flat long plate member 11, on the inner peripheral surface of the commutator, axial latching claws 10*b* and circumferential latching claws 10*c* can be formed. A cylindrical body 12 with high circularity can be thus formed.

In addition, when molding the resin part 9 in this cylindrical body 12, circumferential latching claws 10*c* that are integrally formed on the tip ends of the axial latching claws 10*b* are embedded together with the axial latching claws 10*b*, so that when the resin part 9 thermally contracts and is subjected to a force to try to peel it from the inner peripheral surface of the cylindrical body 12, the circumferential latching claws 10*c* function as resistance against this peeling. Accordingly, the peeling between the cylindrical body 12 and the resin part 9 is prevented and the integration strength increases.

In addition, in this case, pairs of the axial latching claws 10*b* and the circumferential latching claws 10*c* are formed in the circumferential direction across the riser 10*a*. The circumferential latching claws 10*c* are formed so as to project oppositely to each other, so that the entrance of the resin part 9 when molding is in a dovetail shape being narrow circumferentially between the circumferential latching claws 10*c* and wide circumferentially between the axial direction latching claws 10*b* on the outer peripheral side of the circumferential latching claws. Accordingly, the peeling of the resin part 9 from the segment 10 is securely prevented. The integration strength is thus increased more. Further, the circumferential opposing distance between the axial latching claws 10*b* becomes wider toward the outer peripheral side (changes from the width U to the width V), so that this also functions to prevent peeling, so that the strength is further increased.

In this construction, in order to form the axial latching claws 10*b* and the circumferential latching claws 10*c*, only one forcible insertion of the first mold 13 is required, so that the productivity is high.

In this construction, the insertion of the first mold 13 is stopped before reaching the tip end of the cylindrical body 12 so that a non-inserted portion which the pointed portions 12*e* do not get through is provided on the inner periphery of the tip end of the cylindrical body 12 and the tip end axial latching claws 10*d* are formed, so that integration becomes strong also in the axial direction, and the segments 10 are prevented from moving axially.

Figure 9:
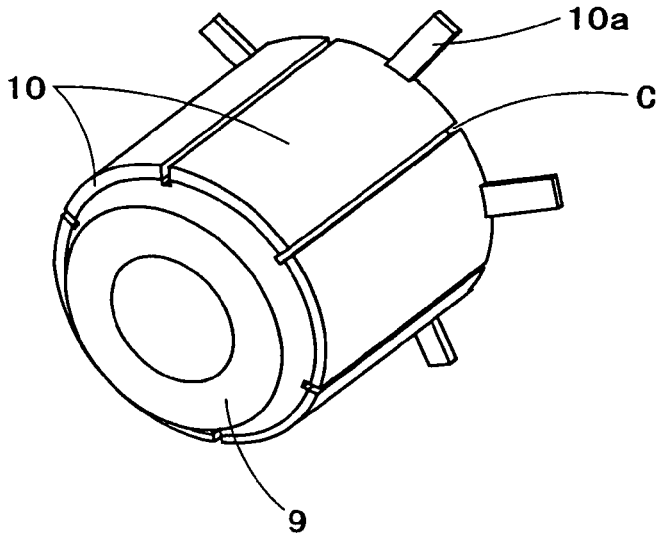
FIG. 9A is a perspective view of a commutator and FIG. 9B is a sectional view of a commutator, both of which shows a second embodiment.
Figure 9:
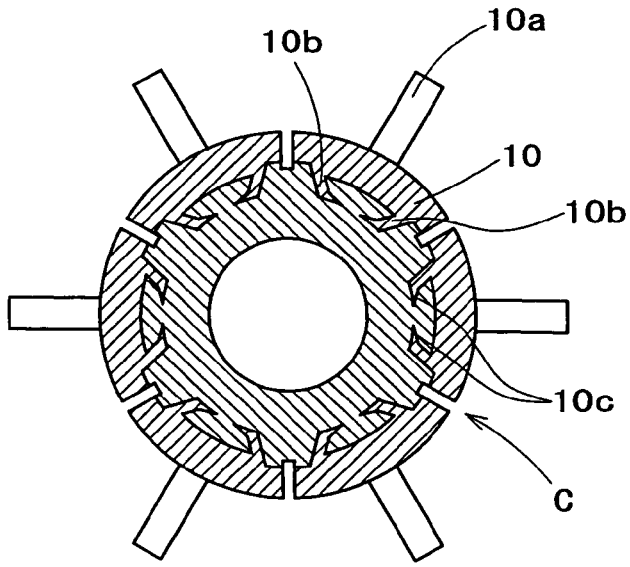
Figure 10:
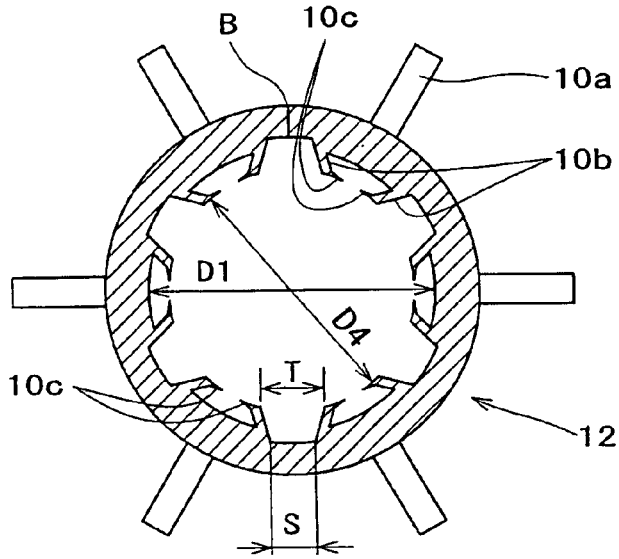
FIG. 10A is a front view of a second mold.
FIG. 10B is a main portion enlarged sectional view of a second mold.
FIG. 10C is a perspective view of a second mold.
Figure 10:
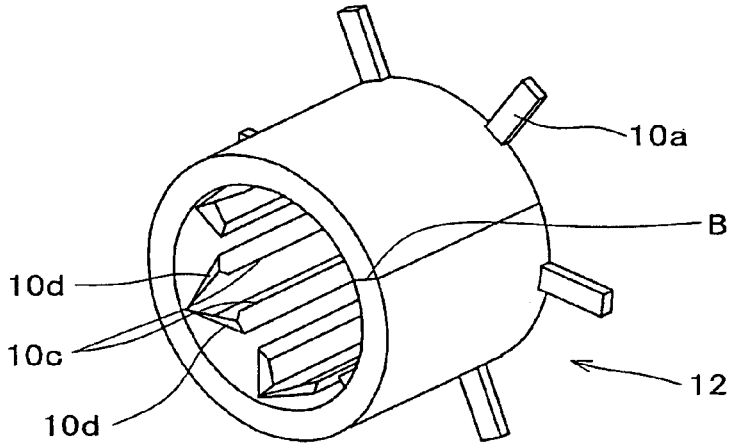
Figure 10:
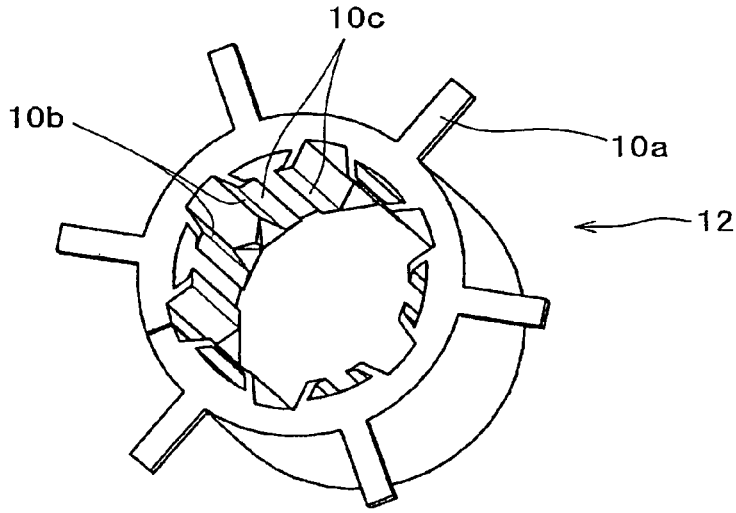
Figure 11:
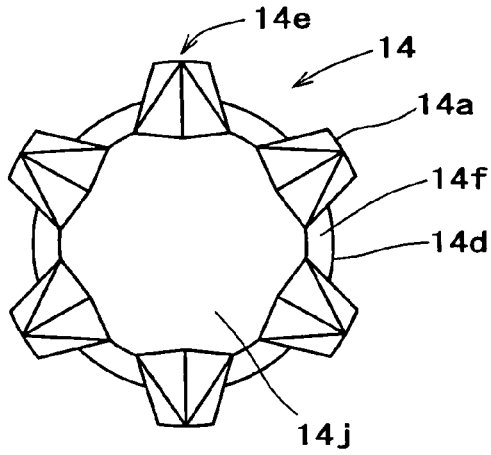
FIG. 11A is a front view.
FIG. 11B is a partially enlarged front view.
FIG. 11C is a partial sectional side view.
FIG. 11D is a back perspective view.
Figure 11:
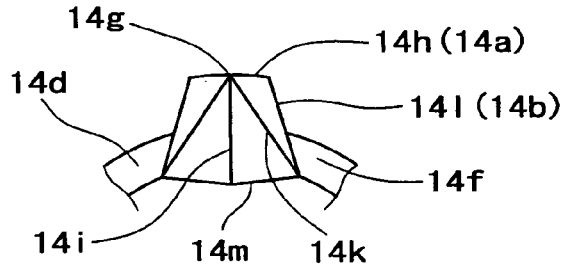
Figure 11:
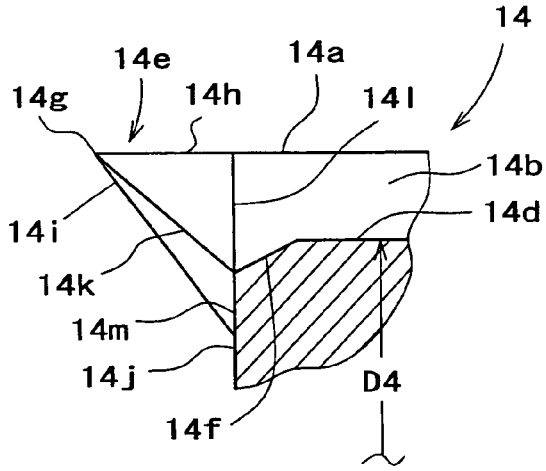
Figure 11:
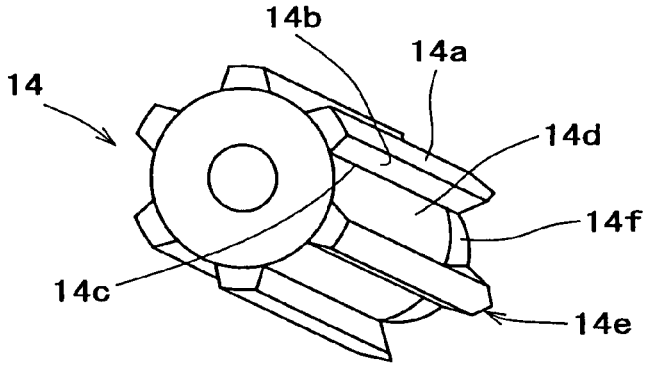
Figure 12:
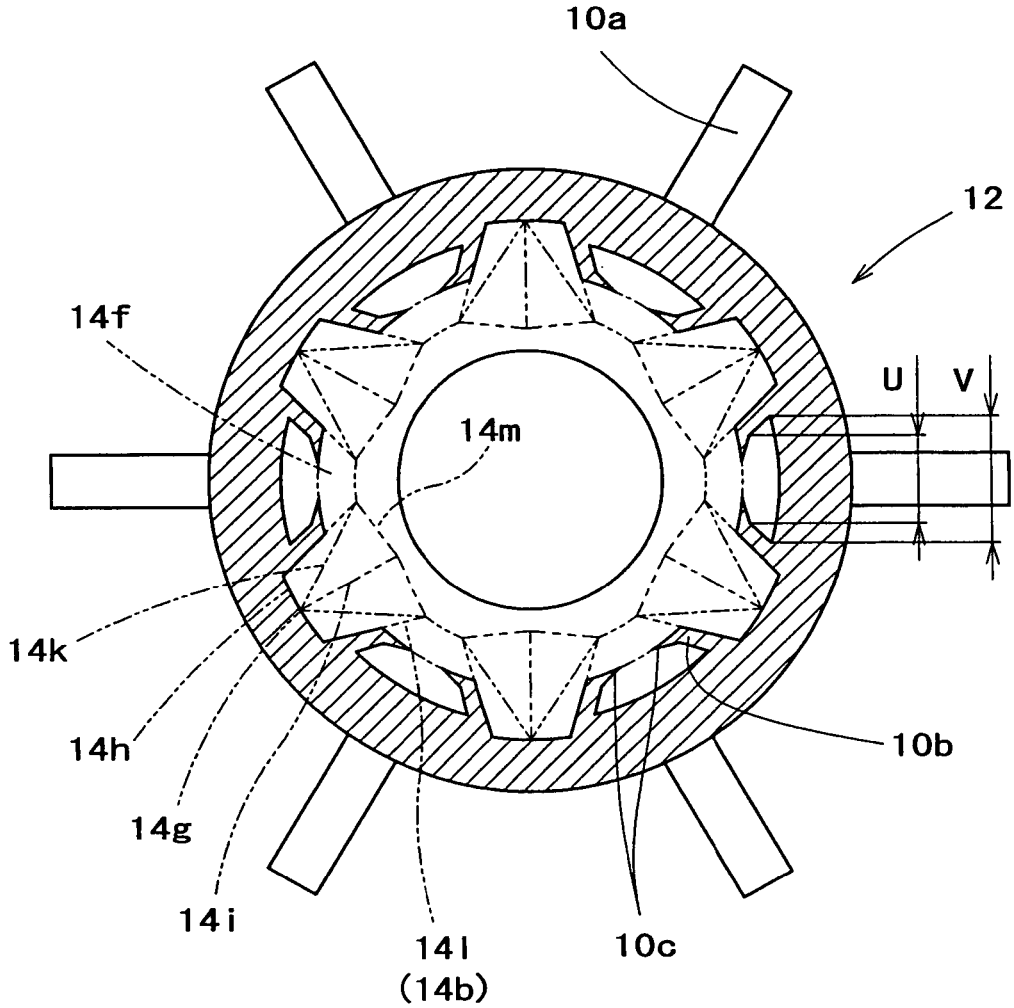
FIG. 12 is a sectional view of a cylindrical body in a state that the second mold is forcibly inserted therein.
Figure 13:
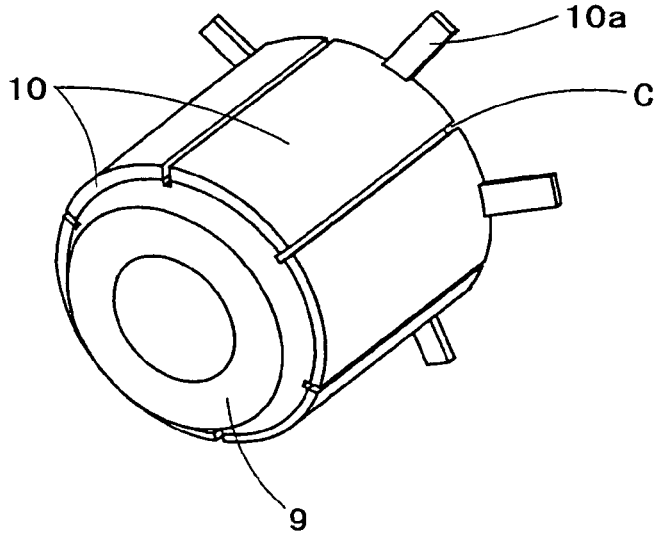
FIG. 13A is a perspective view and FIG. 13B is a sectional view.
Figure 13:
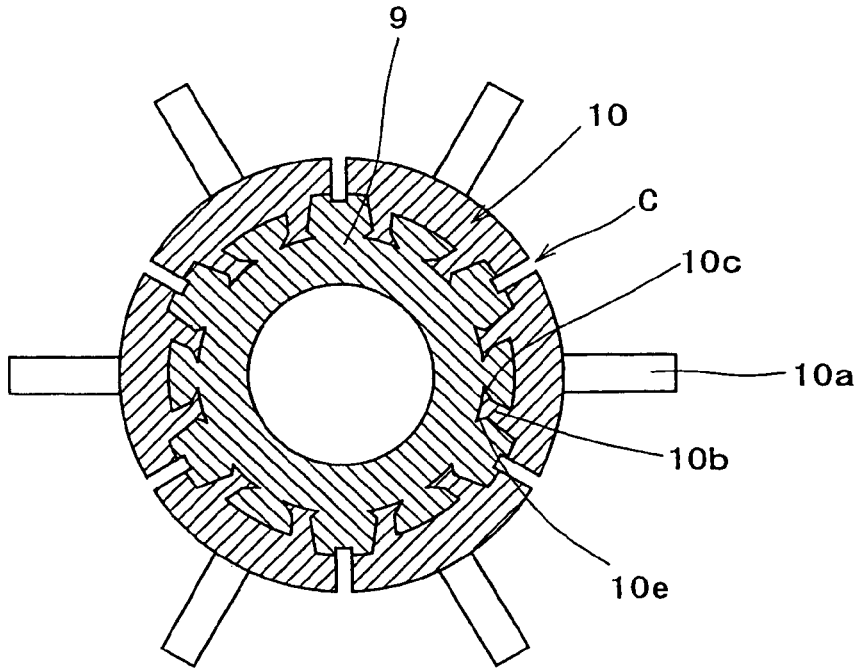
Figure 14:
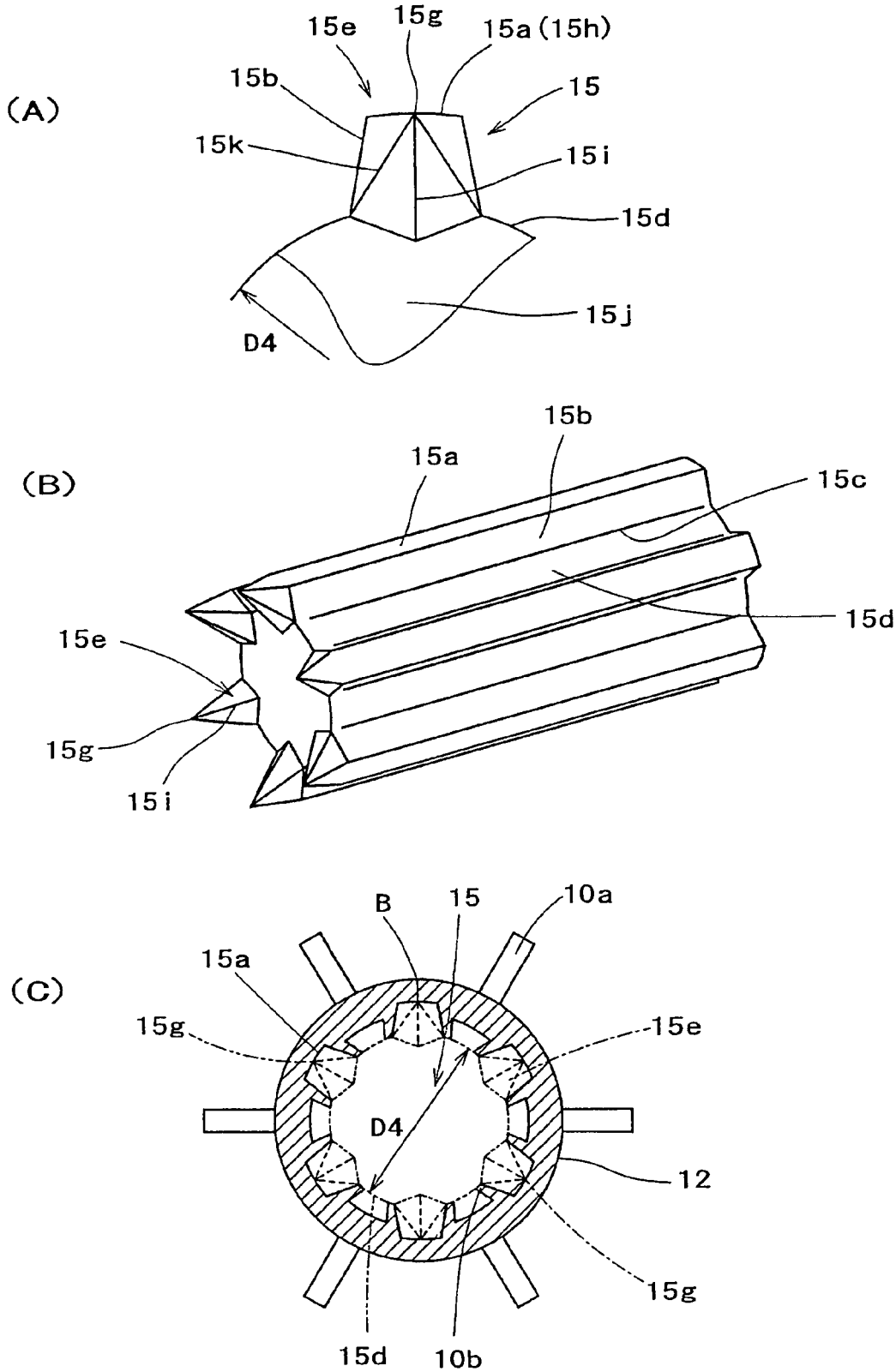
FIG. 14A is a front view of a third mold.
FIG. 14B is a front perspective view of a third mold.
FIG. 14C is a back perspective view of a third mold.
Figure 15:
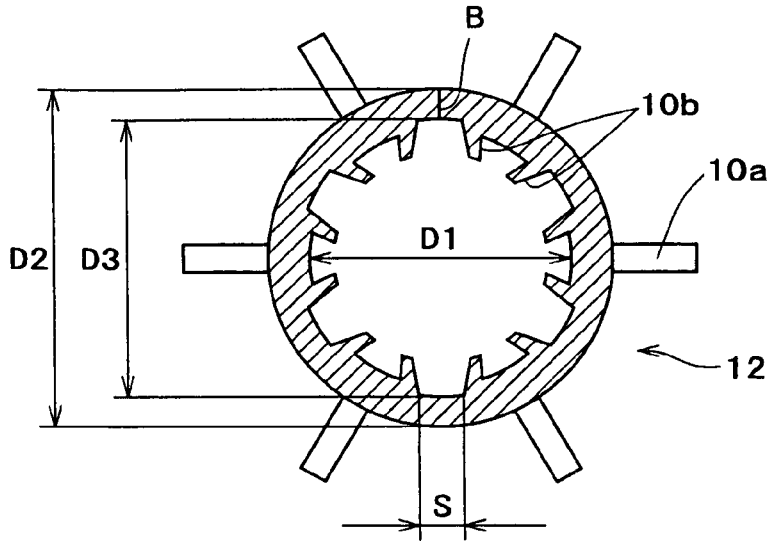
FIG. 15A is a front sectional view.
FIG. 15B is a front perspective view.
FIG. 15C is a back perspective view.
Figure 15:
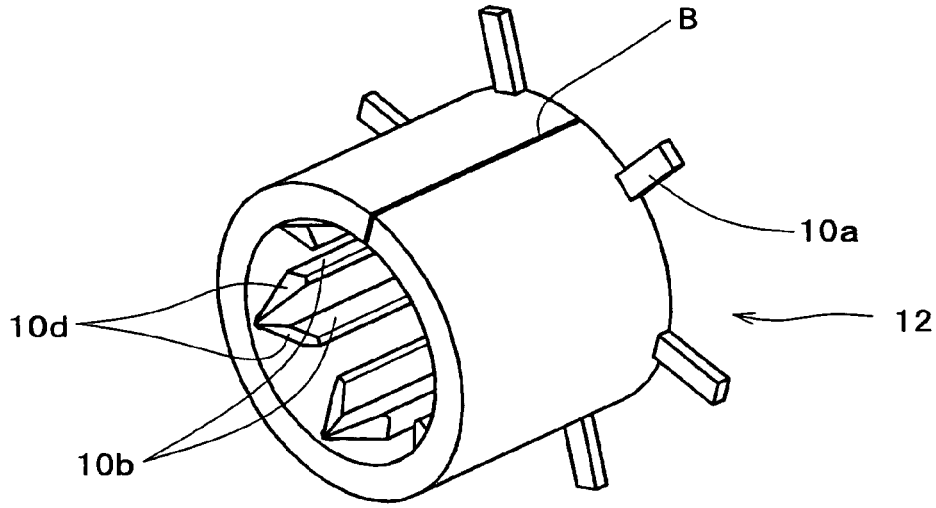
Figure 15:
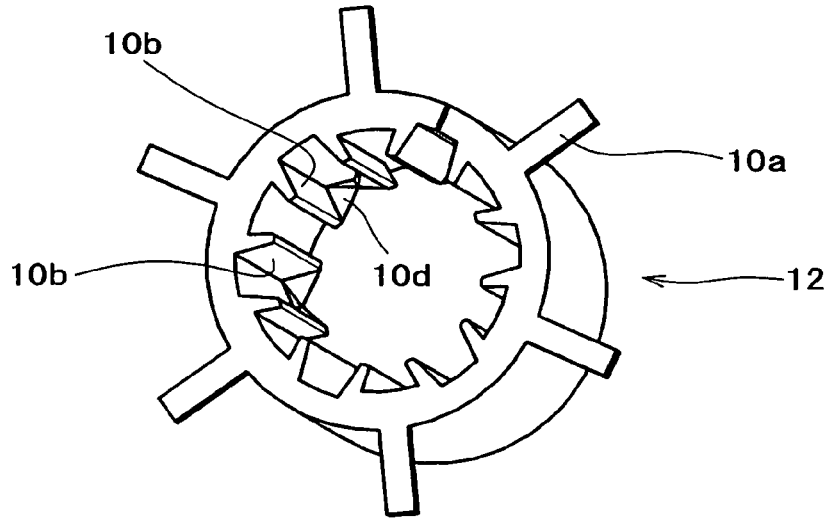
Figure 16:
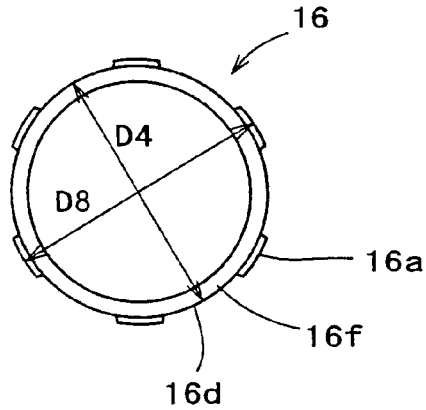
FIGS. 16A and 16B are a front view and a perspective view of a fourth mold.
FIG. 16C is a sectional view of a cylindrical body in a state that the fourth mold is forcibly inserted therein; and Of the cylindrical body subjected to latching claw processing of the third embodiment.
Figure 16:
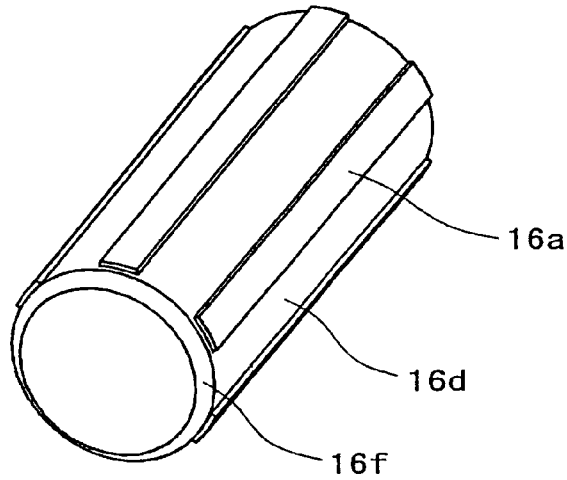
Figure 16:
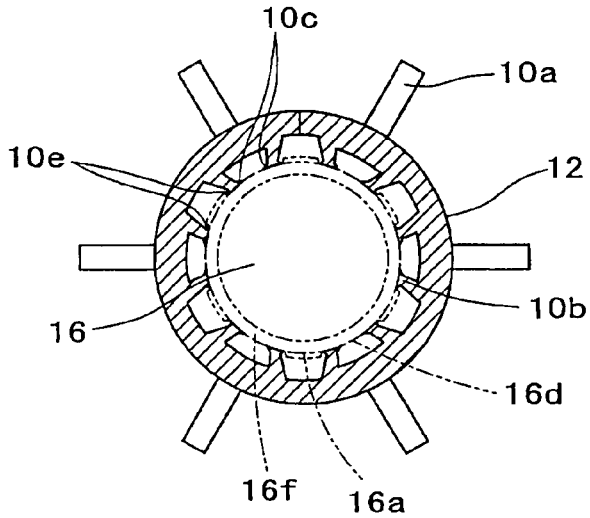
Figure 17:
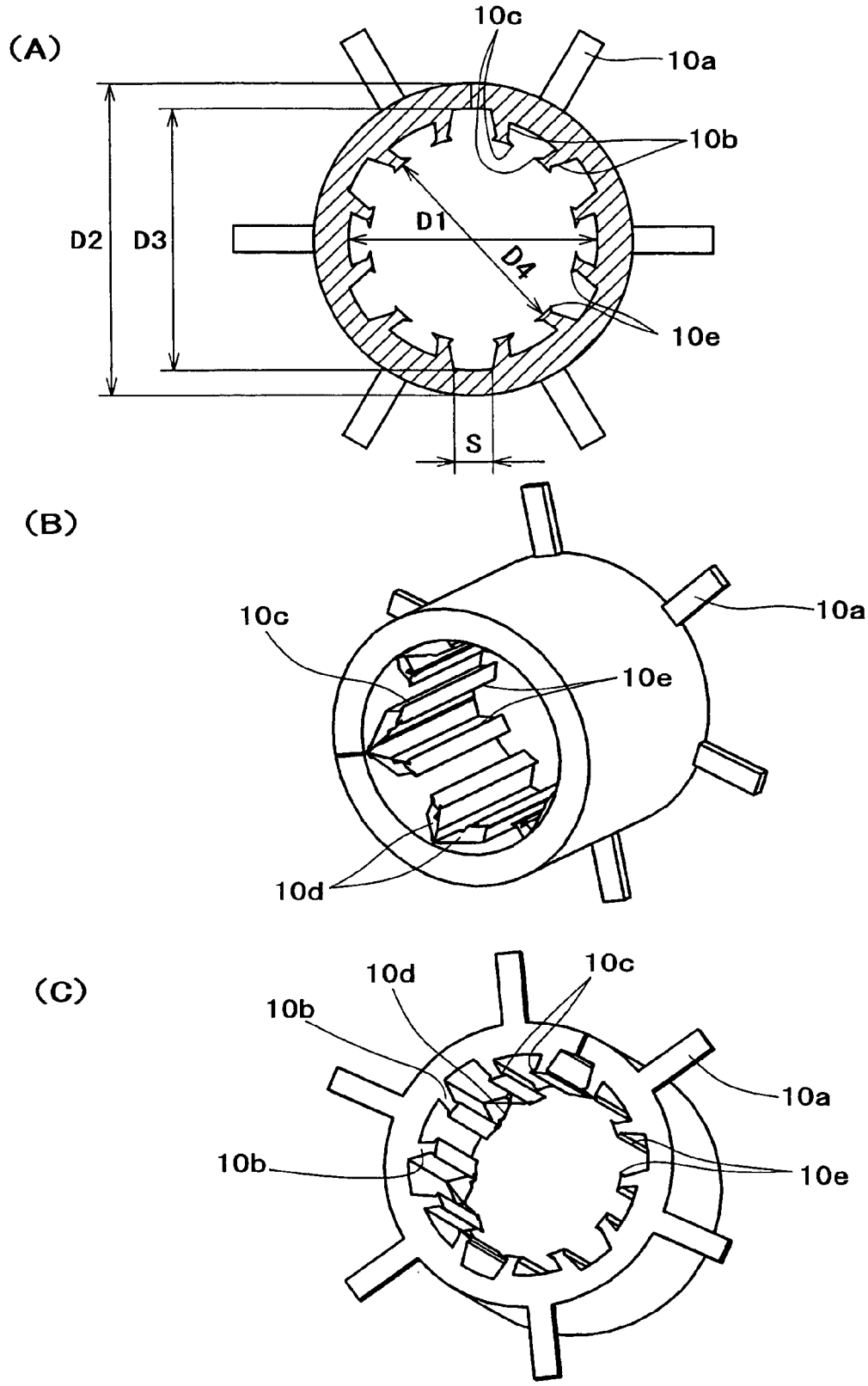
FIG. 17A is a front sectional view.
FIG. 17B is a front perspective view.
FIG. 17C is a back perspective view.

Next, a second embodiment of the present disclosure will be described based on the drawings of FIGS. 9-11. The structure of the electric motor and the structure and the manufacturing method of the cylindrical body 12 are the same as in the first embodiment, so that description of these is omitted. A commutator 5 includes an insulating resin part 9 into which an armature shaft 2 is integrally fitted, and a plurality (six in this embodiment) of segments 10 which are arranged in parallel integrally circumferentially on the outer periphery of the resin part 9 and are formed of a conductive plate member. At ends positioned on armature core 3 sides of the respective segments 10, risers 10*a* around which an end of a winding 4*a* forming a coil 4 is laid for electrical connection to the respective segments 10 are bent and formed in the direction toward the outer diameter. On the inner peripheral surface of each segment 10, as described later, axial latching claws 10*b* having circumferential latching claws 10*c* on their tip ends to be embedded in the resin part 9 are formed so as to project toward the inner diameter side, and accordingly, integration strength against a load in the circumferential direction and integration strength against a load in the axial direction of each segment 10 with the resin part 9 can be increased. In this construction, the axial latching claws 10*b* are inclined greater than those of the first embodiment. Specifically, regarding the pair of axial latching claws 10*b* opposing each other across the riser 10*a*, the difference of the smaller opposing width V on the outer diameter side from the opposing width U on the inner diameter side is set to be larger than the difference of the first embodiment, whereby the peel strength of the resin part 9 is increased.

Next, procedures for forming this commutator 5 will be described based on the drawings of FIGS. 9-11. On the smooth inner peripheral surface 12*a* of the cylindrical body 12, the axial latching claws 10*b* and the circumferential latching claws 10*c* are formed, and setting is made so that these latching claws 10*b* and 10*c* are formed by using a second mold 14 formed to be columnar (see FIGS. 11A-D and FIG. 12).

The basic shapes of the large-diameter portions 14*a*, the stepped portions 14*b*, the corners 14*c*, the small-diameter portion 14*d*, the pointed portions 14*e*, and the chamfered portion 14*f* of the second mold 14 are the same as those of the first embodiment. Detailed description of these is omitted, and the reference numerals indicating the respective parts with lead lines are also the same as those of the first embodiment except that the reference numeral "13" is changed to the reference numeral "14" that is used for the second mold 14 in place of the first mold 13, so that detailed description thereof is omitted. In this construction, the ratio at which the circumferential width S of the tip end of the large-diameter portion 14*a* is smaller than the circumferential width T of the base end is set to be larger than that of the first embodiment. Accordingly, the inserting portion for the resin part 9, formed in the dovetail shape by the axial latching claws 10*b* and the circumferential latching claws 10*c*, becomes narrower toward the entrance side (axis core side), whereby the peel preventing function of the resin part is increased.

Next, a third embodiment of the present disclosure will be described with reference to FIGS. 12-17. The structure of the electric motor and the structure and the manufacturing method of the cylindrical body 12 are the same as in the first embodiment, so that description thereof is omitted. The commutator 5 (see FIG. 13) includes an insulating resin part 9 into which an armature shaft 2 is integrally fitted, and a plurality (six in this embodiment) of segments 10 which are arranged in parallel integrally in the circumferential direction on the outer periphery of the resin part 9 and are formed of a conductive plate member. At ends positioned on the armature core 3 sides of the respective segments 10, risers 10*a* around which an end of a winding 4*a* forming a coil 4 is laid for electrical connection to the respective segments 10 are bent and formed in a direction toward the outer diameter. On the inner peripheral surface of each segment 10, as described later, two circumferential latching claws 10*c* and 10*e* extending oppositely to each other in the circumferential direction on the tip ends of axial latching claws 10*b* embedded in the resin part 9 are formed so as to project. Accordingly, the latching claws form a T shape, and integration strength against a load in the circumferential direction and integration strength against a load in the axial direction of the respective segments 10 with the resin part 9 can be further increased.

Procedures for forming this commutator 5 will be described next. In this construction, first, axial latching claws 10*b* are formed on the smooth inner peripheral surface 12*a* of the cylindrical body 12, and these are set so as to be formed by using a third mold 15 formed into a cylindrical shape (see FIGS. 14A-C). The third mold 15 has six large-diameter portions 15*a* with a preset circumferential length S formed on small-diameter portions 15*d* to form grooves for forming claws on the outer periphery. The large-diameter portions 15*a* project radially, and formed to be long axially, and the outer diameter D3 of the large-diameter portions 15*a* is set to be longer than the inner diameter D1 of the cylindrical body 12 and shorter than the outer diameter D2 of the cylindrical body 12 (D2>D3>D1).

Further, a pair of sides 15*b* opposing each other in the circumferential direction forming each large-diameter portion 15*a* are set so that an opposing distance on the projection tip end side is shorter than an opposing distance on the projection base end side. At a tip end in the inserting direction corresponding to one end in the axial direction of each large-diameter portion 15*a*, a pointed portion 15*e* is formed, and each pointed portion 15*e* is formed in a shape pointed toward the tip end so as to have an outer diameter D3, have an apex 15*g* on an outer diameter end at the portion corresponding to a circumferentially middle position of the large-diameter portion 15*a*, and have ridges 15*h* that lower toward the inner diameter side, and accordingly, the forcible insertion of the cylindrical body 12 is made easy. For the third mold 15, the reference numerals with the lead lines are also attached according to those of the first mold 13.

Then, the portions formed with the pointed portions 15*e* on the third mold 15 are butted against one cylinder end on the side on which the risers 10*a* are formed on the cylindrical body 12. From this state, the third mold 15 is forcibly inserted toward the other end side of the cylindrical body 12 to perform extraction molding toward the other end side of the cylindrical body 12. Thereby, the inner peripheral surface 12*a* of the cylindrical body 12 is extruded by the large-diameter portions 15*a*. Along the sides 15*b* opposing each other in the circumferential direction of the large-diameter portions 15*a*, the axial latching claws 10*b* are formed to be long in the axial direction. At this time, the inner diameter of the tip ends in a direction toward the inner diameter of the axial latching claws 10*b* that are extruded by the large-diameter portions 15*a* are set so as to become larger than the outer diameter D4 of the small diameter portion 15*d* of the third mold 15. When the third mold is forcibly inserted, the tip ends in the direction toward the inner diameter of the axial latching claws 10*b* do not come into contact with the small-diameter portion 15*d* of the third mold 15.

At this time, the third mold 15 is set so that the large-diameter portions 15*a* are inserted into portions at which the cylindrical body 12 is cut axially for forming axial segments in the cylindrical body. Accordingly, on the inner peripheral surface 12*a* of the cylindrical body 12 corresponding to the portion with each segment 10 formed, a pair of axial latching claws 10*b* are formed. The cylindrical body 12 is set so that a butting portion B of the long plate member 11 is set as a cutting portion when forming the segments 10, and the third mold 15 is set to be inserted into the cylindrical body 12 so that the large-diameter portion 15*a* opposes the portion adjacent to the butting portion B.

Further, in the process of forcibly inserting the third mold 15, the third mold 15 is inserted to a position slightly before the apex 15*g* of the pointed portion 15*e* reaches the other end of the cylindrical body 12 to provide a non-inserted portion into which the third mold 15 is not inserted at the other end. Thereby, at the other cylinder end (corresponding to the mold inserting direction tip end of the present disclosure) of the cylindrical body inner peripheral surface 12*a*, a tip end axial latching claw 10*d* whose tip end is closed along the inclined surface leading to the apex 15*g* forming the pointed portion 15*e* is formed. At this time, the pair of axial latching claws 10*b* lead continuously to the tip end axial latching claw 10*d*.

Subsequently, into the cylindrical body 12 on which the axial latching claws are formed, a fourth mold 16 is forcibly inserted to form circumferential latching claws 10*c* and 10*e*. In this case, on the fourth mold 16, six projections 16*a* with the outer diameter D8 are formed circumferentially from the small-diameter portion 16*d* with the outer diameter D4. Herein, the outer diameter D4 of the small-diameter portion 16*d* and the outer diameter D8 of the projections 16*a* are both smaller than the inner diameter D3 of the cylindrical body 12 processed by the large-diameter portions 15*a* according to forcible insertion of the third mold 15. The outer diameter D4 of the small-diameter portion 16*d* is larger than the inner diameter D1 of the cylindrical body 12 on which the axial latching claws 10*b* are formed by forcible insertion of the third mold 15. Further, the tip end in the inserting direction of the fourth mold 16 has a chamfered portion 16*f* formed by chamfering so as to make easy the forcible insertion into the cylindrical body 12.

Then, the projections 16*a* of the fourth mold 16 are positioned at the grooves of the cylindrical body 12 processed by the large-diameter portions 15*a* of the fourth mold 15 and the chamfered portion 15*f* is butted against the axial latching claws 10*b* on one cylinder end on which the risers 10*a* are formed of the cylindrical body 12, and in this state, the fourth mold 16 is forcibly inserted to the other end side of the cylindrical body 12, whereby extrusion toward the other end side of the cylindrical body 12 is performed.

Thereby, the tip ends of the axial latching claws 10*b* are pushed and expanded to both (two) sides of the circumferential direction by the small-diameter portions 16*d* of the fourth mold 16. As a result, at the tip ends of the axial latching claws 10*b*, circumferential latching claws 10*c* and 10*e* extending to both (two) sides of the circumferential direction are formed.

By molding the resin material in the cylindrical body 15, the resin part 9 is integrated with the inner periphery of the cylindrical body 15, and the outer peripheral surface of the integrated member is subjected to cutting to form cut grooves C that are long axially and reach the resin part, whereby the cylindrical body 15 is divided into a plurality of segments 10 in the circumferential direction, and the commutator 5 is constructed.

In this embodiment described above, the commutator 5 can be provided with the axial latching claws 10*b* and the circumferential latching claws 10*c* and 10*e* formed on the inner peripheral surface of the cylindrical body 15 by forcibly inserting the second mold 14 into the cylindrical body 12 formed of a flat long plate member 11, and the cylindrical body 15 with high circularity can be formed.

In this construction, when the axial latching claws 10*b* are embedded in the resin part 9, at the tip ends of the pair of axial latching claws 10*b*, a pair of circumferential latching claws 10*c* and 10*e* extending to both (two) sides of the circumferential direction are formed, so that these latching claws 10*b*, 10*c*, and 10*e* form a T shape and strongly hold the coupling of the resin part 9 with the segments 10, so that the segments 10 can be constructed so as not to peel from the resin part 9 and so as to hold firm integration, and integration strength in the circumferential direction can be increased.

In the present disclosure thus carried out, by the simple construction and processes in which a non-inserted portion is provided on the other end of the cylindrical body 12, by stopping insertion of the third mold 15 before reaching the other end of the cylindrical body 12, the tip end axial latching claws 10*d* can be formed, and by forcibly inserting the fourth mold 16, the circumferential latching claws 10*c* and 10*e* extending to both (two) sides can be easily formed, and can contribute to a reduction in cost.

What is claimed is:

1. A method for producing a commutator comprising a conductive part that has a cylindrical body and a plurality of coil latching portions at intervals circumferentially on one axial end; and an insulating part formed inside the conductive part, wherein the conductive part includes segments that are insulated for each latching portion by cutting axially the conductive part to form cut grooves between adjacent segments, and a pair of latching claws on each segment that are provided to circumferentially oppose each other in a projecting state on an inner peripheral surface of the segments and embedded in the insulating part, the method comprising:

forming the conductive part into the cylindrical body by bending and forming a long plate member; and forming the pair of latching claws of each of the segments on a cylindrical body inner peripheral surface by forcibly inserting a mold into the cylindrical body, wherein the mold has a mold surface that forms axial latching claws such that a pair of axial latching claws of the pair of latching claws are raised from the cylindrical body inner peripheral surface, long in an axial direction, project inward, and oppose each other, by cutting and raising a thickness of the cylindrical body inner peripheral surface at a portion where the cut grooves are formed such that the cutting and raising makes the portion thinner, and a mold surface that forms circumferential latching claws that are bent circumferentially from tip ends of the axial latching claws, and each of the segments, which are formed by the cut grooves, has the pair of axial latching claws and the circumferential latching claws such that a thickness of a portion of the inner peripheral surface between the pair of axial latching claws that circumferentially oppose each other is not cut and raised so as to hold a same thickness as a thickness of the long plate member.

2. The method according to claim 1, wherein the axial latching claws and the circumferential latching claws are formed by forcibly inserting the same mold.

3. The method according to claim 2, wherein the mold surface that forms the axial latching claws and the mold surface that forms the circumferential latching claws are formed so as to form the pair of axial latching claws in a circumferential direction across the coil latching portion and form and oppose the circumferential latching claws to each other circumferentially.

4. The method according to claim 1, wherein after the axial latching claws are formed, the circumferential latching claws are formed.

5. The method according to claim 4, wherein:

the mold surface that forms the axial latching claws forms the pair of axial latching claws in a circumferential direction across the coil latching portion, and the mold surface that forms the circumferential latching claws forms the circumferential latching claws toward both sides in the circumferential direction.

* * * * *